US006070370A

United States Patent [19]

Locke

[11] Patent Number: 6,070,370

[45] Date of Patent: Jun. 6, 2000

[54] ADJUSTABLE ANGLE CORNER FLASHING

[76] Inventor: Matthew Locke, 1830 W. 10th, Eugene, Oreg. 97402

[21] Appl. No.: 09/316,053

[22] Filed: May 21, 1999

[51] Int. Cl.[7] ..... E04D 13/14

[52] U.S. Cl. ..... 52/58; 52/60; 52/287.1

[58] Field of Search ..... 52/58, 60, 287.1, 52/631

[56] References Cited

U.S. PATENT DOCUMENTS

| | | | |
|---|---|---|---|
| 3,364,304 | 1/1968 | Sagendorph . | |
| 4,248,926 | 2/1981 | Tajima et al. . | |
| 4,603,517 | 8/1986 | Lyons, Jr. | 52/60 |
| 4,700,512 | 10/1987 | Laska . | |
| 4,799,986 | 1/1989 | Janni . | |
| 4,872,296 | 10/1989 | Janni . | |
| 5,675,939 | 10/1997 | Hickner . | |
| 5,706,610 | 1/1998 | Mayle . | |
| 5,983,592 | 11/1999 | Mayle | 52/58 X |

*Primary Examiner*—Christopher T. Kent
*Attorney, Agent, or Firm*—James D. Givnan, Jr.

[57] ABSTRACT

An expanse of thermoplastic flashing material is provided with a flap of like material. Upon flexing of the flashing to accommodate corner surfaces of a roof structure, the flap may be heat welded to same to shape the flashing to correspond to the surfaces of the corner. A modified form of the flashing includes a trapezoidal flap heat welded to the flashing expanse and having an extension thereon for securement to an underlying portion of the flashing expanse subsequent to shaping of the flashing to an outside corner of a roof structure. Sloping walls may be sealed as well as vertical, perpendicular walls may be accommodated by the modified flashing. A still further flashing modification includes first and second flaps particularly suited for abutment with vertical intersecting wall surfaces with the flaps being permanently secured to an expanse of flashing by heat welds.

7 Claims, 3 Drawing Sheets

ADJUSTABLE ANGLE CORNER FLASHING

BACKGROUND OF THE INVENTION

The present invention concerns flashing formed of flexible synthetic material for installation on the inside and outside corners of a roof structure.

The application of sheets of synthetic plastic material to roofs is generally termed membrane roofing. Such roofing material is now becoming widely accepted for application to flat roofs for reasons of longevity and ease of application. Typically such roofing material is applied to horizontal flat roof structures of commercial buildings. Corners resulting from structures in place on a roof, as for example, air conditioning housings, skylights, exhaust ventilators, etc. are particularly difficult to seal. Intersections encountered in the application of roofing include inside and outside corners with sloped as well as perpendicularly related surfaces which are susceptible to being a cause of leaks.

In the prior art, U.S. Pat. No. 364,304 discloses flashing including cheese cloth panels on which a thick coating of cement or glue, is applied to provide flashing for metal roofing panels. Overlapped segments of flashing are disclosed U.S. Pat. No. 5,675,939 discloses flashing having symmetrical halves intended for installation beneath the sloped roof and a vertical wall of a building.

U.S. Pat. Nos. 4,799,986 and 4,872,296 disclose pliable plastic flashing for corner installation on membrane roofing with the flashing slotted and having horizontal portions for heat welding to flat roof membrane and with vertical extensions joined by a flexible corner piece heat welded to surfaces of the horizontal portions. The flashing is for corners of roof mounted equipment having vertical wall surfaces.

U.S. Pat. No. 4,248,926 discloses sheet material for flashing use having a layer of knitted fabric material and adjacent layers of a rubber compound for flexure during installation.

U.S. Pat. No. 4,700,512 discloses flashing of the membrane type for installation on both inside and outside corners of foundations and roofs. The intersecting walls and roof surfaces being protected have perpendicular surfaces.

U.S. Pat. No. 5,706,610 discloses flashing having a slit extending from a central area to its perimeter wherein the flashing is comprised of two portions joined by heat welding with one of said portions adapted to seal the intersection of intersecting walls.

SUMMARY OF THE PRESENT INVENTION

The present invention is directed toward providing flashing for inside and outside corners of roof structures, which flashing is highly adaptable to the various wall and roof intersections encountered in roofing installation.

An expanse of flashing is of thermoplastic nature and carries a permanently attached flap having a free portion for heat welding during flashing installation subsequent to manual shaping of the flashing to accommodate a range of corner configurations. The expanse of flashing material defines a slot extending outwardly from a central area of the flashing. The positioning of a free portion of the flap into overlying placement on a flashing surface whereat a heat weld serves to shape the flashing to correspond to the intersecting wall surfaces. Another embodiment for use on outside corners provides a flap of trapezoidal shape for overlying a portion of the flashing expanse for subsequent application of heat and the forming of a heat weld thereto. This modification is adaptable to use on outside corners defined by sloping or intersecting perpendicular wall surfaces vertically disposed to the horizontal roof. A still further embodiment of the present flashing includes a flap of rectangular shape having an extension for overlying securement, as by a heat weld, to a vertically disposed portion of the flashing.

Important objectives include the provision of flashing highly adaptable to use in providing weather tight sealing of inside and outside corners of a roof structure wherein the corners are defined by sloping walls or intersecting vertical walls; the provision of flashing which may be readily shaped to the corner configuration encountered and secured in place by the application of heat and, if desired, by a hand held roller; the provision of flashing having a flap which is formed of a thermoplastic material devoid of reinforcing fabric to preclude degradation of the flap by the application of heat.

DETAILED DESCRIPTION OF THE PREFERRED EMBODIMENTS

Figure 1:
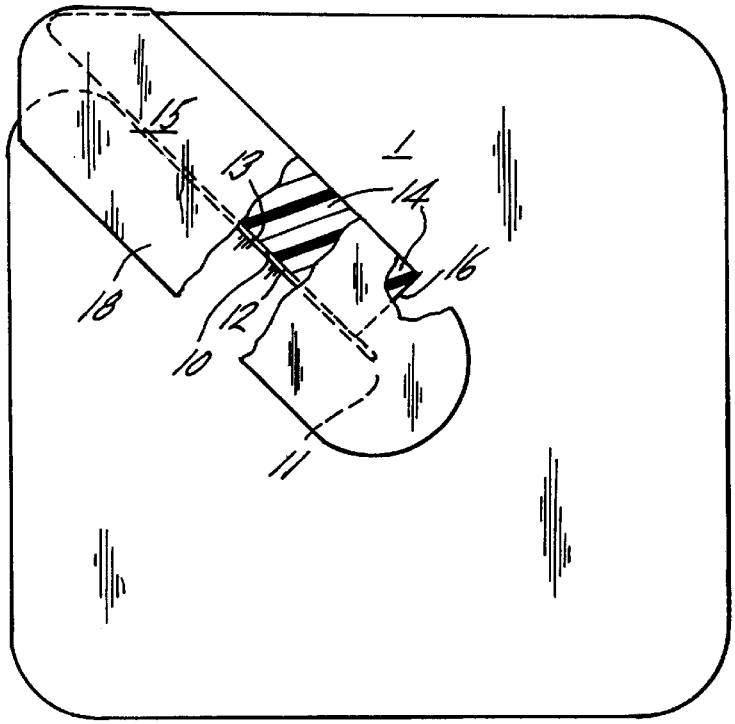
FIG. 1 is a top plan view of flashing for an inside corner of a roof structure with flashing pieces broken away for illustrative purposes.

With continuing attention to the drawings wherein applied reference numerals indicate parts similarly hereinafter identified, the reference numeral 1 discloses a unitary expanse of flashing formed from a pliable thermoplastic material of the type utilized in the manufacture of membrane roofing material. One suitable membrane material comprises a fibrous fabric or scrim of fiberglass or like material provided with surface coatings of polyvinyl chloride. Such a roofing material, in the form of lengthy strips is applied both on flat roof surfaces 3 as well as on adjacent upright wall surfaces, is indicated at 2 in FIG. 2.

Figure 2:
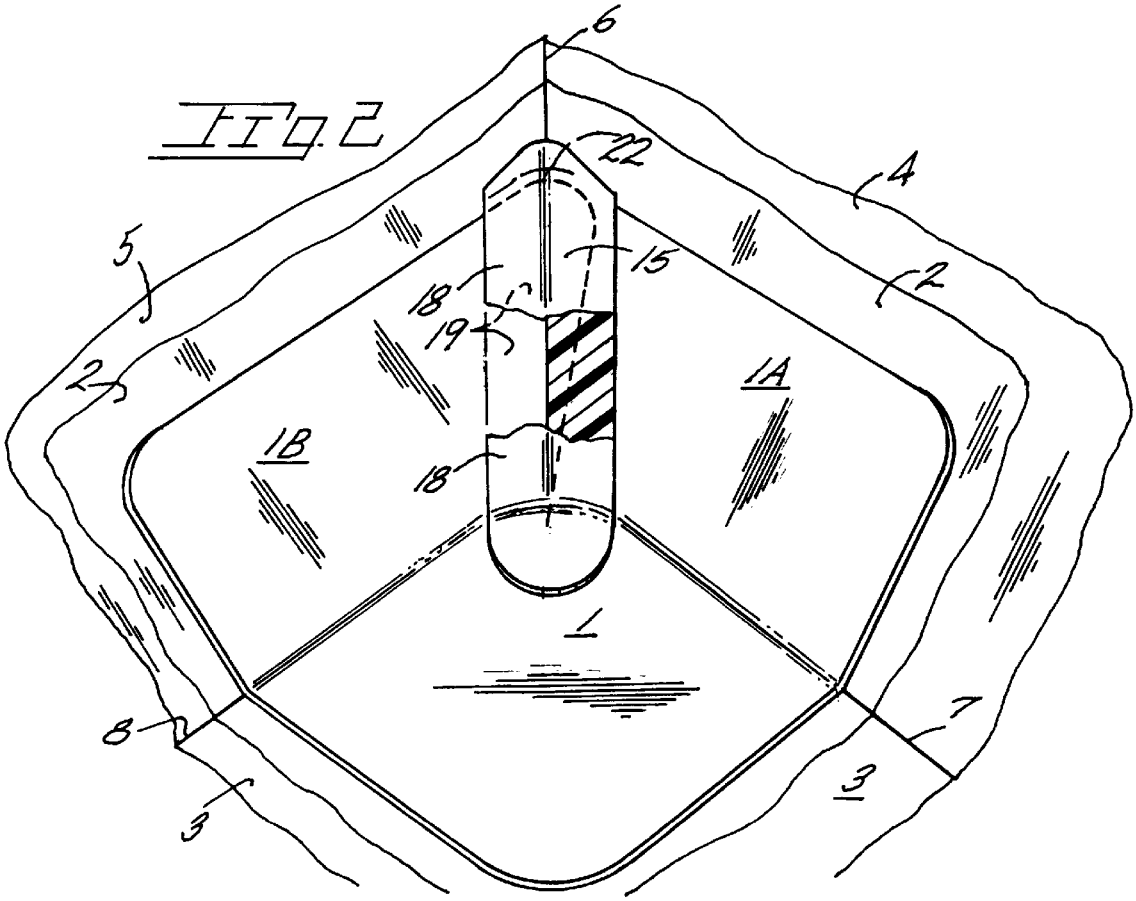
FIG. 2 is a perspective view of the flashing of FIG. 1 installed on an inside corner.

An inside corner is shown in FIG. 2 defined by flat roof surface 3 and sloping wall surfaces at 4 and 5. Sloping surfaces 4 and 5 intersect at 6 and also intersect with flat roof surface 3 at 7 and 8 and form what is termed an inside corner.

Inside corner flashing 1 is substantially rectangular and defines a slot 10 diagnonally extending from a central area 11 of flashing 1. Slot 10, defined by parallel edges 12 and 13, terminates adjacent a corner of flashing 1 which are preferably radiused.

A flap 15 is secured as by a heat weld at 14 to flashing 1 along one margin of slot 10. The heat weld terminates at 16 somewhat offset from center area 11 of the flashing.

With attention to FIG. 2, wherein flashing 1 is shown in place on an inside corner defined by a horizontal or flat roof surface 3 and sloping roof surfaces 4 and 5, the flap 15 will be located over wall intersection 6 with a free portion 18 of the flap being displaced away from slot defining edge 13 to locate free portion 18 in overlying relationship with a now inclined portion of flashing 1 overlying sloping wall 5 with free portion 18 of the flap now located for securement by the application of heat. Typically a heat gun is used to heat free portion 18 and subjacent area at 19 to use same. Accordingly, upon the weld being completed the upwardly inclined flashing surfaces at 1A and 1B will be joined by flap 15. Flap 15 may be trimmed along dashed line 22 for appearance sake.

Figure 3:
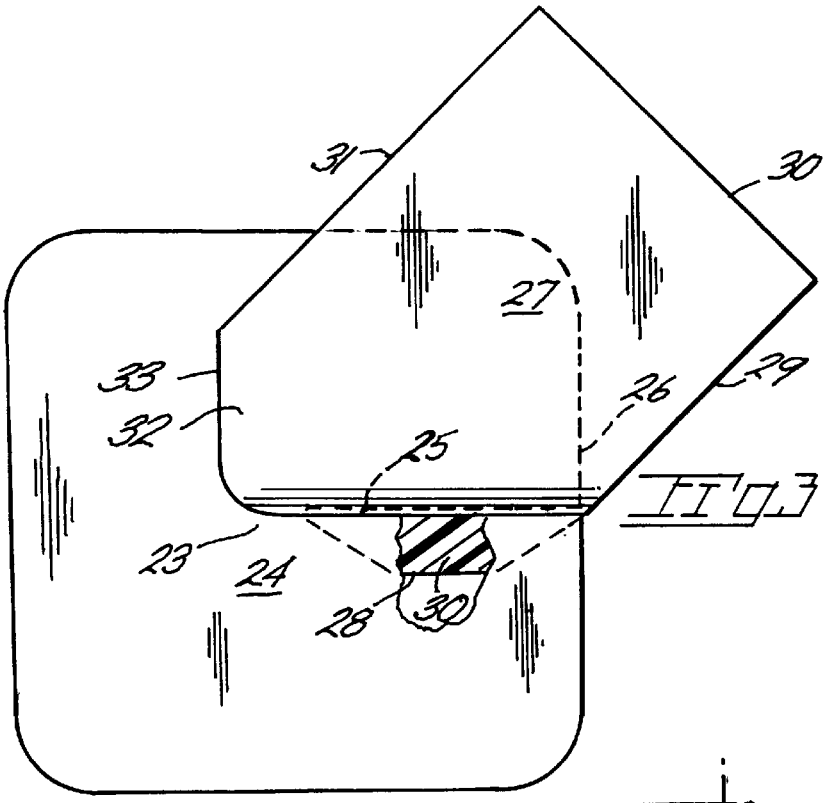
FIG. 3 is a plan view of a modified form of the flashing for installation on an outside corner of a roof structure.
Figure 4:
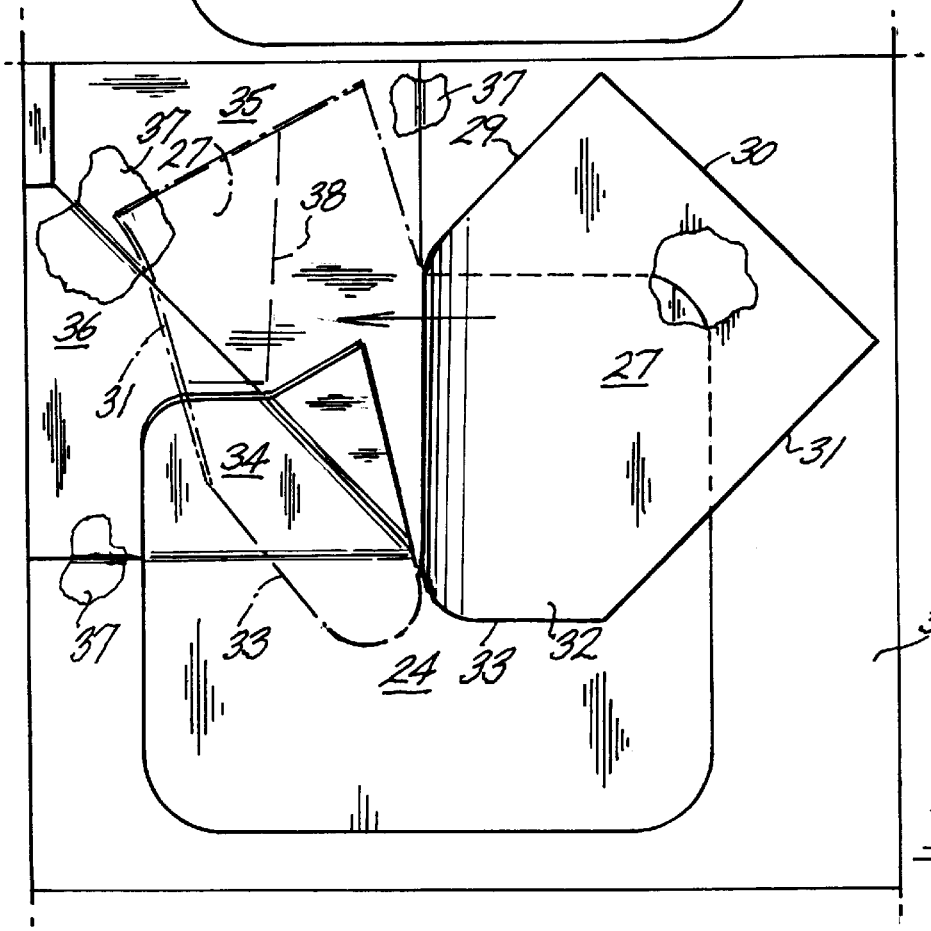
FIG. 4 is a top plan view of the flashing of FIG. 3 partially installed on sloping wall surfaces of an outside corner.
Figure 5:
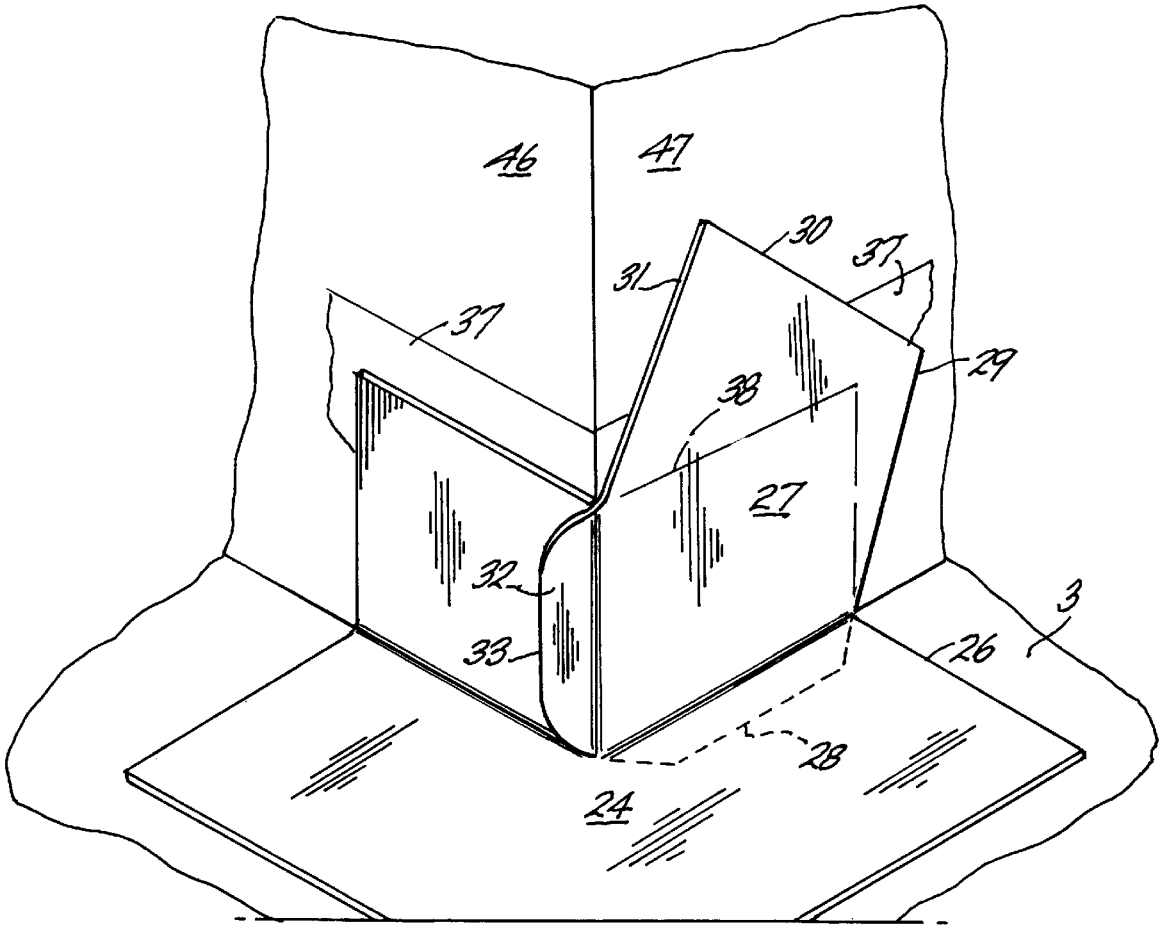
FIG. 5 is a perspective view of the flashing shown in FIG. 3 applied to an outside corner defined by intersecting vertical walls.

With attention now to FIGS. 3–5 showing flashing for an outside corner of a roof structure, the expanse of flashing at 24 may be of the same material from which flashing 1 is formed. A slot 25 extends from a side 26 of the rectangular flashing inward toward a center area 23 of the flashing. A flap at 27 is preferably trapezoidal and includes a tab 28 which passes through slot 25 for affixing as by a heat weld area 30 to the underside of the flashing expanse 24. Flap 27 is now free to be positioned about an axis parallel to slot 25. Flap 27 is preferably of a thermoplastic material similar to that utilized for flashing 24 but preferably does not include a fibrous scrim as later elaborated. Flap edges are at 29, 30 and 31. A flap extension 32 terminates in an edge 33 with the extension providing added surface area to the flap for subsequent securement during flashing installation to an upwardly inclined surface area 34 (FIG. 4) to retain the flap and remaining portion of the flashing in place on outside corner walls 35,36 having an overlayment thereon of membrane roofing material 37. When in place, as shown in FIG. 5, flap 27 may be trimmed along dash line 38 for appearance sake.

Figure 6:
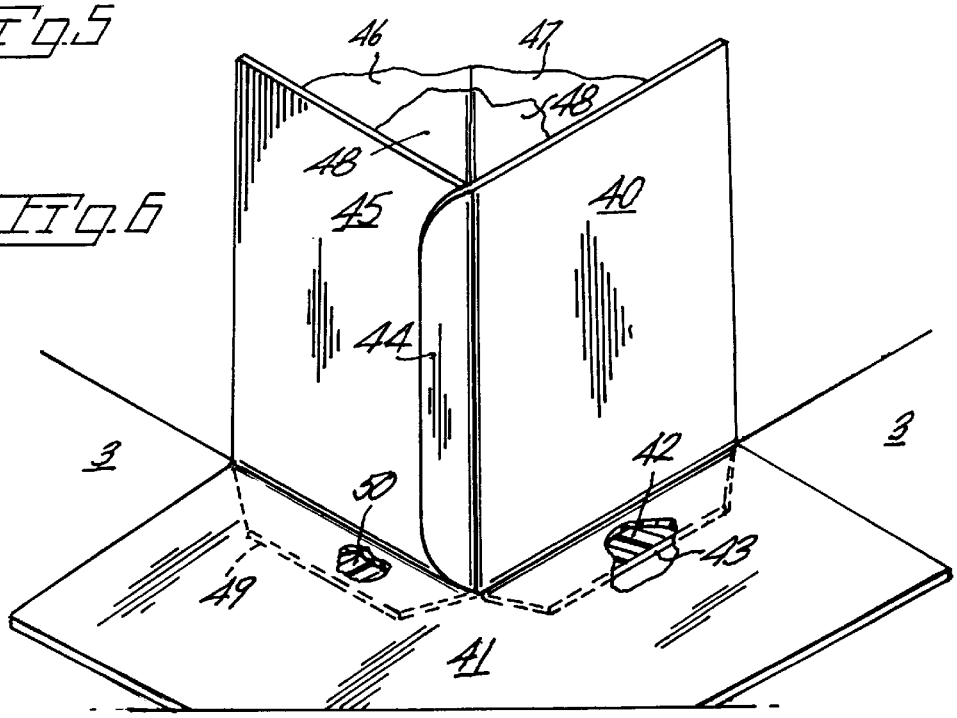
FIG. 6 is a perspective view similar to FIG. 5 but showing a further modified form of flashing.

In FIG. 6 a modified form of outside corner flashing is provided with a flap particularly intended for sealing intersections of vertical walls of unusual height. A first flap 40 is attached to the expanse of flashing at 41 by a heat welded area 42 attaching a tab 43 on the first flap to the underside of the flashing. An extension 44 on said first flap is for flexing into overlying engagement with a second flap 45 when both the first and second flaps are in vertical abutment with vertical wall surfaces 46–47 and a membrane 48 thereon. A tab 49 on flap 45 is secured by a heat weld 50 to the flashing underside. The first and second flaps may be of like material previously described in connection with the flap shown in FIG. 5, i.e., thermoplastic and without a fibrous scrim, as it is beneficial to avoid utilizing scrim when flap surfaces are subjected to heat during a heat weld as such heat degrades the scrim to jeopardize flap integrity. As the first and second flaps 40 and 45 can be of extended length the modified version of FIG. 6 is particularly suited for installation on intersecting walls of an outside corner of greater than usual height.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. Flashing for installation on a roof and on a corner of intersecting wall surfaces inclined to the roof, an expanse of fusible plastic sheet material having a perimeter, an edge extending inwardly from the perimeter of said expanse, a marginal area on said expanse and bounded by said edge, a flap of thermoplastic material secured to said expanse on said marginal area and having a free portion, a portion of said expanse positionable on one of said inclined wall surfaces beneath said flap during flashing installation on the corner, said flap attachable to said portion by a heat weld to retain the flashing in a configuration corresponding to the roof and wall surface of the corner.

2. The flashing claimed in claim 1 wherein said expanse is of rectangular configuration, said edge diagonally disposed on said expanse.

3. The flashing claimed in claim 2 wherein said flap is elongate and terninates at a central area of said expanse and at the perimeter thereof.

4. The flashing claimed in claim 1 wherein said flap is substantially trapezoidal, said flap having a distal edge outwardly offset from the perimeter of said expanse.

5. The flashing claimed in claim 4 wherein said free portion of the flap includes an extension for securement upon flashing installation to said expanse.

6. The flashing claimed in claim 1 wherein said flap is of unreinforced thermoplastic material.

7. The flashing claimed in claim 1 additionally including a second flap, the first mentioned flap including a marginal area for attachment by a heat weld to a vertically disposed portion of said second flap when in place on vertical wall surface.

* * * * *